United States Patent [19]

Edkins

[11] Patent Number: 4,968,025

[45] Date of Patent: Nov. 6, 1990

[54] PORTABLE GYMNASTIC TRAINING APPARATUS

[75] Inventor: Benjamin S. Edkins, Chapel Hill, N.C.

[73] Assignee: Carolina Gym Supply Corp., Chapel Hill, N.C.

[21] Appl. No.: 404,084

[22] Filed: Sep. 7, 1989

[51] Int. Cl.[5] ..... A63B 3/00

[52] U.S. Cl. ..... 272/109; 272/63

[58] Field of Search ..... 272/62, 63, 64, 65, 272/93, 109, 144, 145; 446/85, 125

[56] References Cited

U.S. PATENT DOCUMENTS

| | | | |
|---|---|---|---|
| 3,518,786 | 7/1970 | Holtvoigt | 446/85 |
| 3,628,790 | 12/1971 | Gordon | 272/109 X |
| 3,857,561 | 12/1974 | Cecchettini et al. | 272/63 X |
| 4,147,828 | 4/1979 | Heckel et al. | 272/109 X |
| 4,210,322 | 7/1980 | Pritchard | 272/109 |

FOREIGN PATENT DOCUMENTS

| | | | |
|---|---|---|---|
| 2733708 | 2/1979 | Fed. Rep. of Germany | 446/125 |
| 2804346 | 8/1979 | Fed. Rep. of Germany | 272/63 |
| 1282241 | 7/1972 | United Kingdom | 446/85 |

*Primary Examiner*—Robert Bahr

*Attorney, Agent, or Firm*—Olive & Olive

[57] ABSTRACT

A gymnastic training device comprises a pair of rectangular blocks each of which has a formed handrail simulating a parallel bar secured along one top side edge of the block and extending for the length of the block and a pliable cover over the block and handrail, each said block and its handrail being formed of a lightweight, resilient, plastic material enabling a pair of the blocks to be placed spaced apart with the respective handrails in opposed parallel positions to simulate gymnastic exercises on a conventional parallel bar.

10 Claims, 3 Drawing Sheets

PORTABLE GYMNASTIC TRAINING APPARATUS

BACKGROUND OF THE INVENTION

1. Field of the Invention

The invention relates to gymnastic training apparatus and more specifically to an apparatus useful for simulating parallel bars and exercises performed thereon.

2. Background Art

Lightweight rectangular blocks of covered plastic foam material are used as so-called spotting blocks on which instructors and coaches stand while aiding gymnasts in skills or while observing progressions of gymnasts.

Parallel bars have also long been used for gymnastic training particularly in men's gymnastics and typically comprise a pair of spaced apart, parallel wooden bars on metal supports. When using conventional parallel bars it has been the practice to cushion the floor beneath and alongside the bars so that the gymnast will have a cushioned surface below the bars in the event of a fall from the parallel bars.

The present invention recognizes that it would be desirable to modify the referred to spotting blocks to assume the form of a portable training apparatus simulating parallel bars that would enable a gymnast to simulate the type of exercise normally performed on parallel bars and that would also provide, in effect, a cushioned support on both sides of the simulated parallel bars in the event of a fall. The provision of such an apparatus thus becomes the principle object of the invention. Other objects will become apparent as the description proceeds.

SUMMARY OF THE INVENTION

The gymnastic training apparatus of the invention comprises a pair of rectangular blocks each of which is formed with a protruding rib made of a resilient plastic foam material and formed as a simulated handrail which extends along the length of one upper edge of the block. Each block has a lightweight, rigid plastic foam core which is covered on the sides, ends, top and bottom with a layer of another resilient plastic foam material and is entirely enclosed by a cover formed of a relatively thin plastic sheet. The portions of the covers over the handrails are preferably of a contrasting color so as to make them readily visible to the gymnast.

In one mode the pair of gymnastic training blocks of the invention are employed by placing the blocks so that the two handrails are parallel and spaced apart by approximately the width of the body of the gymnast who may be a male or female gymnast using the invention apparatus. In this mode, the gymnast, typically a male gymnast, then trains on the invention apparatus by placing his hands on the handrails and utilizing the handrails in the same manner as the gymnast would utilize a pair of conventional parallel bars.

In another mode, the blocks can be used alongside a balance beam on which a gymnast, typically a female gymnast, is training for use either as a spotting block or as protection in the event the gymnast falls from the beam. Other applications and uses of the gymnastic training apparatus of the invention will become apparent as the description proceeds.

DESCRIPTION OF THE PREFERRED EMBODIMENT

Figure 3:
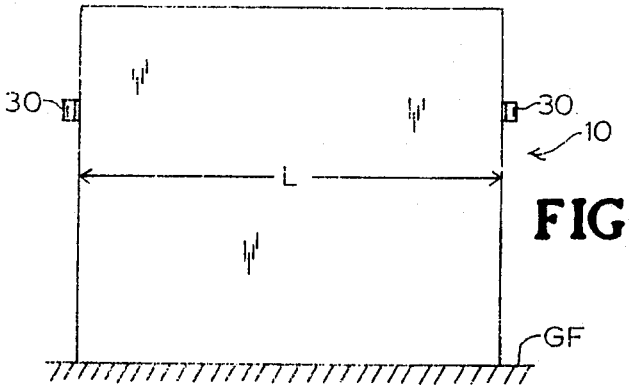
FIG. 3 is a side view taken in the direction of line 3—3 of FIG. 2.
Figure 4:
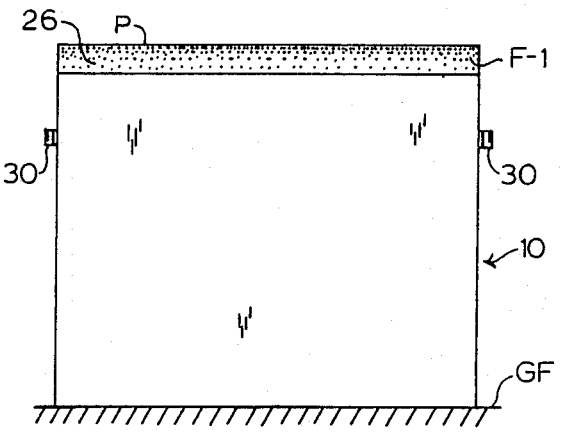
FIG. 4 is a side view taken in the direction of line 4—4 of FIG. 2.
Figure 5:
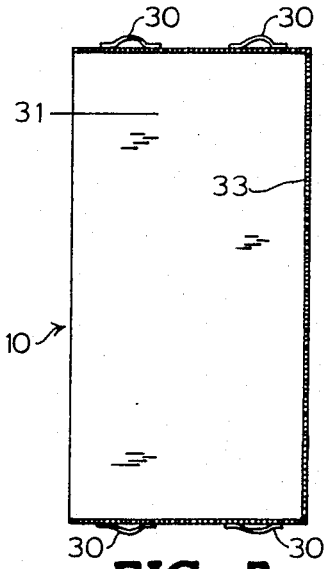
FIG. 5 is a bottom view of one of the blocks shown in FIG. 1.
Figure 6:
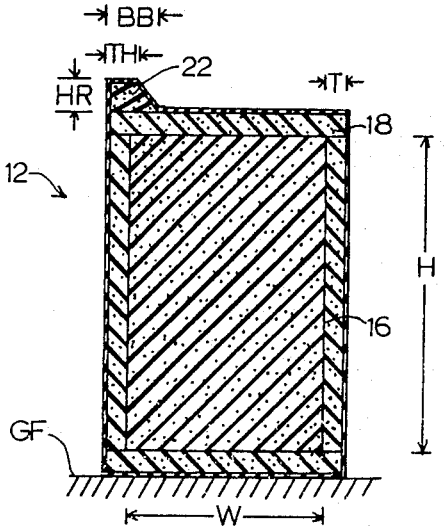
FIG. 6 is a cross-section view taken through one of the blocks in the direction of line 6—6 of FIG. 2.

Making reference to the drawings and the illustrated embodiment used by way of example, each block of the pair of blocks 10, 12 is formed with an expanded relatively rigid polystyrene core 14 having a one pound density (1 lb. per cubic foot PCF) formed by resilient closed cells and in the illustrated embodiment has a height H (FIG. 6) of approximately three (3) feet, a length L of approximately four (4) feet (FIG. 3), and a width W (FIG. 6) of approximately two (2) feet. A suitable material for core 14 is sold as EPS insulation by Tri-State Foam Products, Inc. of Martinsville, Va. 24113. An outer somewhat more resilient polyolyfin foam layer 16 having a thickness T (FIG. 6) of approximately 1.25 inches is glued to the top, bottom, side and end surfaces of core 14. Layer 16 by reason of being formed of a material of greater resilience than core 14 serves both to protect the core 14 and provide a greater degree of overall resiliency to the block assembly. A suitable material for layer 16 is sold as type XH200 material by Huls America, Inc. of South Holland, Ill. 60473. A protective cover 18 formed of a thin, pliable coated vinyl sheet material is fabricated and shaped to slip on over the entire block assembly. A bottom cover flap 31 is closed by a zipper type fastener 33 (FIG. 5).

Figure 1:
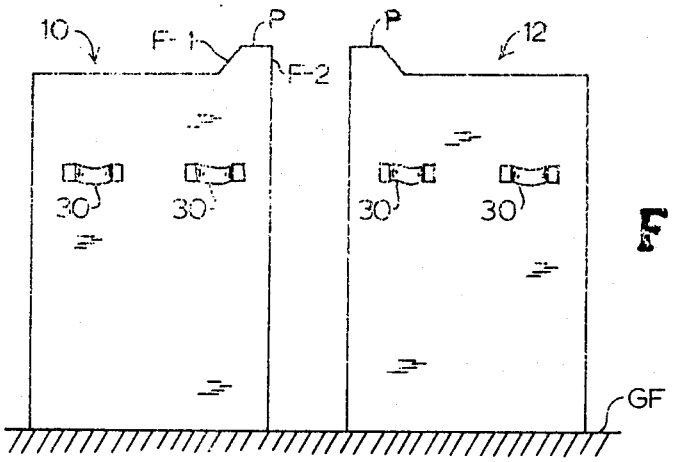
FIG. 1 is an end view of a pair of gymnastic training blocks according to the invention.
Figure 2:
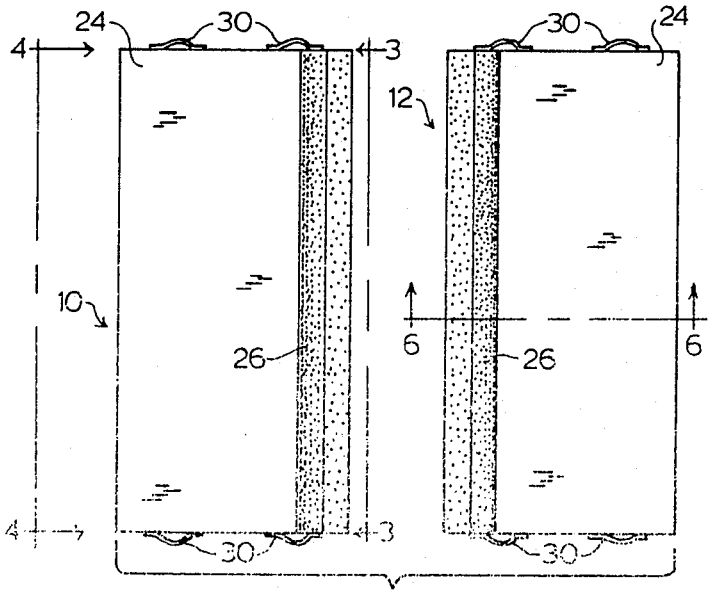
FIG. 2 is a top view of the gymnastic training blocks of FIG. 1.

Of particular significance to the invention each block 10, 12 is provided with a simulated bar or handrail 22 formed of a relatively rigid foam material. A closed cell, chemically crosslinked, polyelthelene foam material having a tough, firm yet elastic feel and sold as Mincell-L200. by the Voltek Division of Sekisui America Corporation of Lawrence, Mass. 01843 has been found suitable. Each handrail 22 is illustrated as being of a somewhat trapezodial shape in cross section having a height HR of approximately 1½ inches, a bottom base BB of approximately 3½ inches, a top width TH of approximately 2 inches and extends for the length L of the block. The shape of the handrail 22 may be other than that shown but in general should provide a top palm receiving surface P and finger supporting surfaces F-1, F-2 as labelled in FIG. 1 and should be shaped to avoid substantial flexing of the fingers and wrists. While the block assemblies of the invention could be used without cover 18, the vinyl cover 18 desirably covers each handrail 22 and, as previously mentioned, is preferably of a contrasting color over the handrail to provide visual discrimination to the gymnast. For example, each handrail cover 26 (FIG. 2) may be of a bright orange with the top fabric 24 being of a contrasting color such as a dark blue. The cover over the sides and ends of the block may also be of different colors for contrast and appearance.

In the illustrated embodiment each block with its cover has an overall weight of approximately 48 pounds and is readily portable utilizing pairs of woven polypropylene straps 30 sewn to the material forming cover 18 on each end of the block as illustrated. Molded in handle grips or other lifting means may be substituted.

Figure 7:
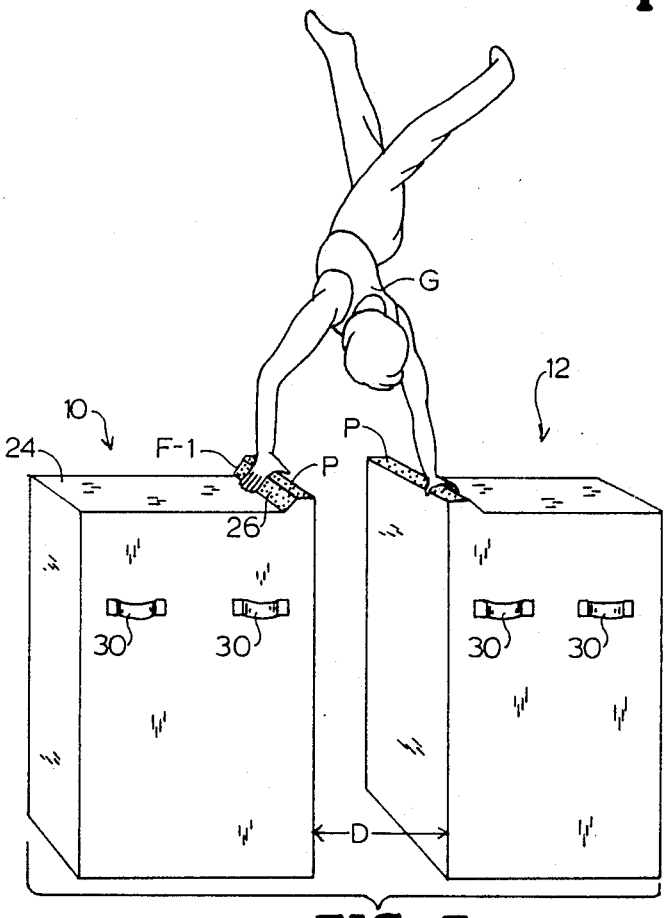
FIG. 7 is a perspective view illustrating a gymnast utilizing the training blocks of the invention as parallel bars.
Figure 8:
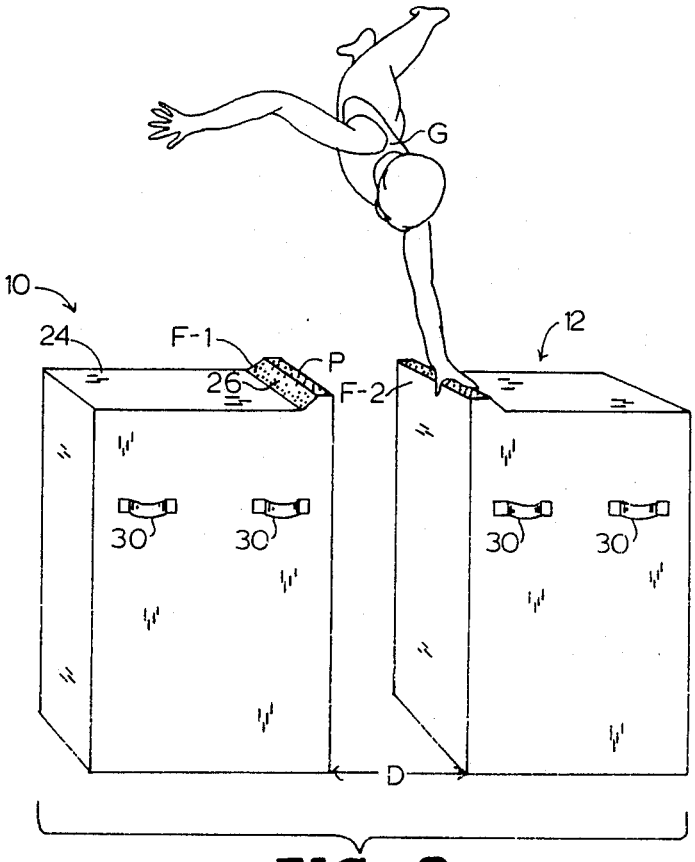
FIG. 8 is a perspective view illustrating a gymnast utilizing the training blocks of the invention for a hand support.

The blocks 10, 12 are typically used by being placed on a suitable mat, not shown, residing on the gym floor GF (FIG. 1) and are spaced apart a distance D (FIG. 1) corresponding to a width slightly greater than the width of the body of the gymnast G who uses the apparatus. A handstand may be performed utilizing the handrails, as in FIG. 7 or a one-arm support as in FIG. 8 as well as numerous other exercises in the same manner as on parallel bars and without any tendency to tip the blocks. The height H (FIG. 6) is selected to permit the lower leg portion of the gymnast to swing through between the blocks 10, 12.

Handrails 22 provide a true simulation of skills customarily performed on regular parallel bars. The handrails also allow for both visual and tactile cues in developing skills for the regular parallel bars in men's gymnastics. The handrails also reduce the potential of hyper-flexion in the wrists while training on the blocks of the invention.

Additional applications of the invention blocks 10, 12 in gymnastics include use as a "beam table" when the blocks are placed with one on either side of a balance beam in order to provide a potential support area adjacent to the beam when a female gymnast is learning skills on the beam. Instructors and coaches may also use the blocks as spotting blocks and stand on them when spotting, i.e. assisting, male or female gymnasts on skills and progressions on the various gymnastics apparatus. While useful in men's gymnastics in the same manner as parallel bars, the blocks 10, 12 of the invention are beneficial for training above bar skills, i.e. stutzkehres and back tosses. Due to their light weight and shock absorbing character, blocks 10, 12 also provide a safer and more forgiving surface in comparison to conventional parallel bars. Thus, an overall desired and needed apparatus for gymnastic training is provided by the invention.

While specific materials have been described by way of example, those skilled in the art will recognize that the invention lends itself to a wide choice of materials.

What is claimed is:

1. A portable gymnastic training device simulating parallel bars comprising a pair of training block members each which comprises:

(a) a rectangular core block formed of a lightweight, relatively rigid plastic foam material having side, end, top and bottom surfaces, a defined width and length and a height sufficient to permit the lower leg portion of a gymnast to swing between a pair of said block members;

(b) a simulated handrail providing upper palm support and side finger support surfaces formed of a relatively resilient plastic foam material, said simulated handrail being formed as a protuberance from and extending for the length of one upper side edge of the core block and secured thereto; and (c) said pair of block members being adapted to be placed so as to orient the respective handrails parallel to each other and spaced apart to simulate parallel bars and being of a size and weight permitting use without tipping when the weight of the gymnast is applied to either or both of said handrails.

2. A gymnastic training device as claimed in claim 1 including a thin, pliable, plastic cover covering said core block and handrail.

3. A gymnastic training device as claimed in claim 2 including strap handles secured to said cover on opposite ends of said block member.

4. A gymnastic training device as claimed in claim 1 including a layer of resilient plastic foam material adhered to the top, ends and side surfaces of each of said blocks and of a resilience character to enhance the overall resilience of the block member and protect the top, end and side surfaces thereof.

5. A gymnastic training device as claimed in claim 1 wherein the said width of said block is at least two feet, the said length is at least substantially twice the width and the said height is greater than said width but less than said length.

6. A portable gymnastic training device as claimed in claim 1 including for each said block means providing a visual color discrimination between the said block top surface and the handrail.

7. A portable gymnastic training device as claimed in claim 1 wherein each said handrail is formed of a material different from the material of which each said block is formed.

8. A portable gymnastic training device simulating parallel bars comprising a pair of training block members each of which comprises:

(a) a rectangular core block formed of a lightweight, relatively rigid plastic foam material having side, end, top and bottom surfaces, a defined width and length and a height sufficient to permit the lower leg portion of a gymnast to swing between a pair of said block members;

(b) a simulated handrail providing upper palm support and side finger support surfaces formed of a relatively resilient plastic foam material, said simulated handrail being formed as a protuberance of and extending for the length of one upper side edge of the core block and secured thereto;

(c) said pair of block members being adapted to be placed so as to orient the respective handrails parallel to each other and spaced apart to simulate parallel bars and being of a size and weight permitting use without tipping when the weight of the gymnast is applied to either or both of said handrails;

(d) a thin, pliable, plastic cover covering said core block and handrail; and (e) wherein the color of said plastic cover covering the palm support and side surfaces of each said handrail contrasts with the color of the plastic cover covering the top surface of the block to provide visual discrimination between the said block top surface and the handrail.

9. A portable gymnastic training device simulating parallel bars comprising a pair of training block members each of which comprises:

(a) a rectangular core block formed of a lightweight, relatively rigid plastic foam material having side, end, top and bottom surfaces, a defined width and length and a height sufficient to permit the lower leg portion of a gymnast to swing between a pair of said block members;

(b) a simulated handrail providing upper palm support and side finger support surfaces formed of a relatively resilient plastic foam material, said handrail being formed as a protuberance of and extending for the length of one upper side edge of the core block and secured thereto;

(c) said pair of block members being adapted to be placed so as to orient the respective handrails parallel to each other and spaced apart to simulate parallel bars and being of a size and weight permitting use without tipping when the weight of the gymnast is applied to either or both of said handrails.

(d) a layer of resilient plastic foam material adhered to the top, ends and side surfaces of each of said blocks and of a resilience character to enhance the overall resilience of the block member and protect the top, end and side surfaces thereof; and (e) wherein said core block is formed of an expanded polystyrene foam material, said layer is formed of a polyolyfin foam material, said handrail is formed of a polyethelene foam material and said cover is formed of a vinyl sheet.

10. A portable gymnastic training device simulating parallel bars comprising a pair of training block members each of which comprises:

(a) a rectangular core block formed of a lightweight, relatively rigid plastic foam material having side, end, top and bottom surfaces, a defined width of at least two feet and a length at least substantially twice the width and a height greater than said width but less than said length sufficient to permit the lower leg portion of a gymnast to swing between a pair of said block members;

(b) a simulated handrail providing upper palm support and side finger support surfaces formed of a relatively resilient plastic foam material, said simulated handrail being formed as a protuberance of and extending for the length of one upper side edge of the core block and secured thereto;

(c) said pair of block members being adapted to be placed so as to orient the respective handrails parallel to each other and spaced apart to simulate parallel bars and being of a size and weight permitting use without tipping when the weight of the gymnast is applied to either or both of said handrails; and (d) wherein said core block is formed of an expanded polystyrene foam material, said layer is formed of a polyolyfin foam material, said handrail is formed of a polyelthelene foam material and cover is formed of a vinyl sheet.

* * * * *